US007207929B2

(12) United States Patent
Hamilton

(10) Patent No.: US 7,207,929 B2
(45) Date of Patent: Apr. 24, 2007

(54) SAFE GRIP WEIGHTS

(75) Inventor: Jeff J. Hamilton, 511 S. 4th St., Eldridge, IA (US) 52748

(73) Assignee: Jeff J. Hamilton, Eldridge, IA (US)

( * ) Notice: Subject to any disclaimer, the term of this patent is extended or adjusted under 35 U.S.C. 154(b) by 0 days.

(21) Appl. No.: 10/883,175

(22) Filed: Jul. 1, 2004

(65) Prior Publication Data

US 2006/0003874 A1 Jan. 5, 2006

(51) Int. Cl.
*A63B 21/00* (2006.01)

(52) U.S. Cl. ..... 482/106; 482/108

(58) Field of Classification Search ..... 482/104–108; D21/191–198

See application file for complete search history.

(56) References Cited

U.S. PATENT DOCUMENTS 5,853,355 A * 12/1998 Standish ..... 482/106
D448,055 S * 9/2001 Lien et al. ..... D21/681
6,436,015 B1 * 8/2002 Frasco et al. ..... 482/106
6,746,380 B2 * 6/2004 Lien et al. ..... 482/106

* cited by examiner

*Primary Examiner*—Jerome Donnelly
(74) *Attorney, Agent, or Firm*—Jay R. Hamilton

(57) ABSTRACT

This design is placed and or positioned in the periphery of weight creating a semi-protective and semi-recessed area for insertion of a hand or hand like device. The size and shape of the area reduces the potential for unattended and damaging interaction between the hand and its digits or the hand-like devices and the sides of the mass. The curvature of the area along with the width being of sufficient size to facilitate grasping during human interaction of the opening are purposefully designed to ergonomically fit the hand and or hand like device for a plurality of uses. The functionality of the device is to generally distribute the stress and forces applied to the point of interaction between the human user and the contact area of the heavy and or cumbersome object. Substantially increasing the controllability during mass manipulation by purposeful human interaction. The depth of the barbell weight grip must be large enough to accommodate the thickness of the average adult human hand and ranges in most case from 1–3 inches. It may be reduced or enlarged during manufacture as necessary to accommodate non-average size users.

25 Claims, 6 Drawing Sheets

SAFE GRIP WEIGHTS

CROSS REFERENCE TO RELATED APPLICATIONS (Not applicable)

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX (Not Applicable)

BACKGROUND OF THE INVENTION

The difficulty of lifting and or working with a heavy object increases proportionately with its size. The difficulty of working with a heavy object is compounded when the object is also round in shape and has a smooth finish. This is the situation facing those familiar with the practice of "lifting weights". Those experienced in lifting weights normally engage in this practice to build muscle mass. See U.S. Pat. No. 5,137,502 ('502) issued to Anastassi and U.S. Pat. No. 6,746,380 ('380) issued to Lien et. al. for further background and discussion on this subject.

Those engaging in this practice that use "free weights" to train as compared to weight resistance machines, find themselves continually loading and unloading barbells or free weight which are heavy and cumbersome. Many times these weights have either no handle or just a simple hand-hole in the weight to be used as a handle to facilitate picking up the weight and to improve grip on the weight when picked up. Once upon a time the practice of lifting weights was the exclusive domain of power lifters, bodybuilders and football linemen. Injuries related to "slamming iron" within this group were considered a badge of honor for novice lifters. A frequent injury acquired is when one plate is loaded next to another and the tissue of the hands or fingers is pinched between the weight plates. Another injury common occurs if the weight plate slips as the plate is unloaded from the bar or placed on the ground and hands or fingers or caught between the weight plate and the ground or floor.

More experienced lifters have learned over time to avoid the potential injuries related to loading and unloading heavy weights through caution and expertise. Over the last fifteen years, however, the practice of lifting weights has been found by trainers, coaches and athletes to potentially improve the performance of almost any athlete including sprinters, basketball and baseball players. The popularity of weightlifting then has greatly increased the number of people exposed to weight lifting as well as the potential exposure of novices or part-time lifters to the dangers and difficulties of lifting free weights. Unfortunately, no one, until now, has taught an apparatus to avoid this type of injury. In fact, the teachings of the prior art may have compounded the problem.

The '502 patent issued in 1992 teaches incorporating openings into the outer portions of the face of the weight plate. This teaching improved the handling of heavy weights and allowed the user to pick the weight off the floor. The '502 patent teachings also provided the user with an opportunity to put his hands in harms away when he stacked more than one weight onto a barbell bar.

The '380 patent issued in 2004 claims to also teach a system useful in preventing injuries and assisting a user in gripping a weight. The teachings do allow a user to insert his or her hands into a hand hole for use a grip. This assists the user with picking the weight up off the floor. The teaching then exacerbates the injury situation by ensuring that there is no virtually no space between the two weight plate hand holes as the weight plates are inserted onto the barbell bar and interlocked thus crushing the inattentive, novice and many times exhausted user's hands or fingers.

BRIEF SUMMARY OF THE INVENTION

This invention generally relates to the field of exercise equipment and more specifically to weights or barbells. The weights as described herein are sometimes referred to by those using the weights as "free weights" or simply "plates". In accordance with the present invention, an improved weight plate is provided that is easily moved from a flat support surface. The weight plate includes a planar body having a central opening for receiving a barbell or dumbbell bar there through.

The new ergonomic design as described herein shall work well for any human manipulated and controlled mass including free weights. The depth of the opening and the curvature of the area along with the width of the opening are purposefully designed to ergonomically fit the hand and or hand like device for a plurality of uses. This design creates a semi-protective area for insertion of a hand or hand like device. The size and shape of the area reduce the potential for unattended and damaging interaction between the hand and the side edges of the weight plates and the faces of the plates. The design disclosed could be expanded to also protect a hand-like device from interaction with the face or sides of the mass.

The weight includes a disc member having a circular opening disposed in the center and a rounded outer rim or ring 11. Disposed on either side of the circular opening are a pair of diametrically opposed, circular openings. The openings are disposed parallel to one another and equidistant from the circular opening. The circular openings are positioned in the weight so that the fingers and thumb of a human hand can be disposed through the openings for sufficient gripping of the weight. The invention as disclosed a portion of the outer rim at the face edge of the weight plate has been removed at the point where the openings are to create a barbell grip.

The problem solved by the invention as disclosed is to reduce the potential for the user's hands, after insertion into the barbell weight grip opening to come into contact with the weight plate face as the weight plates are inserted onto the barbell bar. The potential for smashing the user's hand between the edge formed between the face of the plate and the rim of the weight plate is dramatically reduced by the barbell grip while still allowing the practical advantage of barbell grip opening for insertion of the user's hand. Barbell grip 14 is sized so that an average human hand will be protected when the inner face of the weight plate contacts the outer face of the previously inserted weight plate, the inner edges forming the barbell grip to protect the user's hand or a hand like device.

It is an objective of the invention as described to generally distribute the stress and forces applied to the point of interaction between the human user and the contact area of the heavy and or cumbersome object. It is another objective of the invention as described herein to improve the control of free weights as typically used in physical exercise. It is another object to make the control and manipulation of heavy objects, including free weights, safer. It is another objective of the invention as described to improve the user's control and manipulations of objects. Finally, it is a further object of the invention to improve a weight lifter's control and manipulation of the free weights.

BRIEF DESCRIPTION OF THE DRAWINGS

FIG. 1 is a top perspective showing common free weight barbell plates with hand openings located directly across from each other.

FIG. 2 is a top side perspective showing how the lifter's hand engages with the free weight barbell plate as found in the prior art.

FIG. 3 is a top side perspective showing how the lifter's hand engages with the grip found on the improved free weight barbell plate which is the subject of this invention.

FIG. 4 is a top side perspective showing the stacking of multiple free weight barbell plates implementing the improved grip.

FIG. 5 is a top side perspective showing a single improved grip barbell weight plate.

FIG. 6 is a bottom side perspective showing a single improved grip barbell weight plate.

DETAILED DESCRIPTION OF THE INVENTION

LISTING OF THE ELEMENTS

| NUMBER | DESCRIPTION |
|---|---|
| 10 | Barbell Weight or "Plate" |
| 11 | Barbell Weight Ring or Rim |
| 12 | Barbell weight grip opening |
| 13 | Lifter's hand |
| 14 | Barbell Weight Grip |
| 15 | Plate Face |
| 16 | Barbell center hole |
| 17 | Barbell collar |
| 18 | Barbell bar |

The following description is provided to enable any person skilled in the art to make and use the invention and sets forth the best modes contemplated by the invention of carrying out his invention. Various modifications, however, will remain readily apparent to those skilled in these arts, since the generic principles of the present invention have been defined herein.

Figure 1:
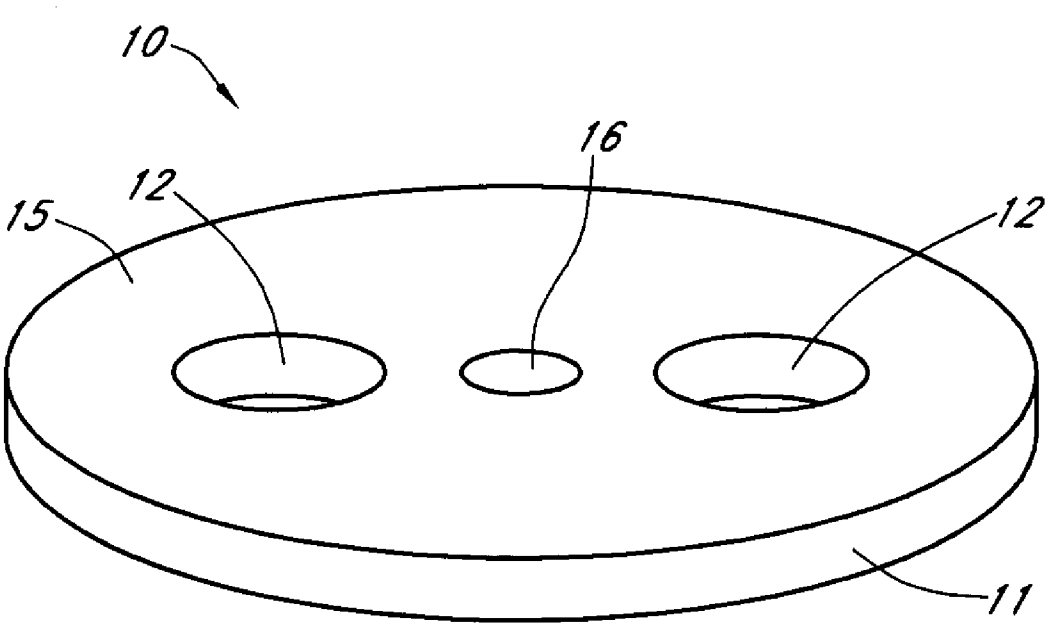
FIG. 1 (PRIOR ART)
FIGS. 1 and 2 show free weights barbell plates as they are commonly found in the prior art now.
Figure 2:
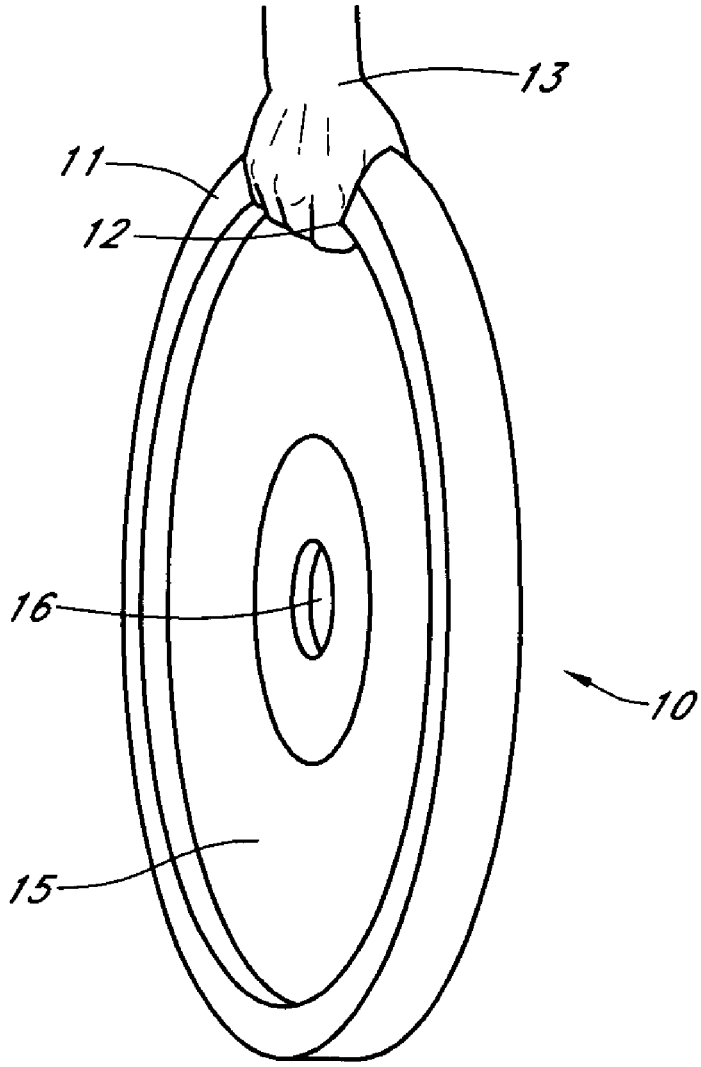
FIG. 2 (PRIOR ART)

FIGS. 1 and 2 show a weight as described in the prior art. The weight 10 includes a disc member having a circular opening 16 disposed in the center and a rounded outer rim or ring 11. Disposed on either side of the circular opening 16 are a pair of diametrically opposed, circular openings 12. The openings 12 are disposed parallel to one another and equidistant from the circular opening 16. The circular openings 12 are positioned in the weight 10 so that the fingers and thumb of a human hand (shown in FIG. 2) can be disposed through the openings 12 for sufficient gripping of the weight 10.

FIG. 2 shows how a human hand 13 would interact as described in the prior art. As described, the distance between the outer sides of either opening 12 are dimensioned so that the fingers of the human hand can be disposed through the opening 12 and the thumb can be wrapped around the outer edge of the weight 10 for sufficient gripping of the weight 10. The periphery inner edges of the openings are rounded to aid in gripping the weight 10.

Figure 3:
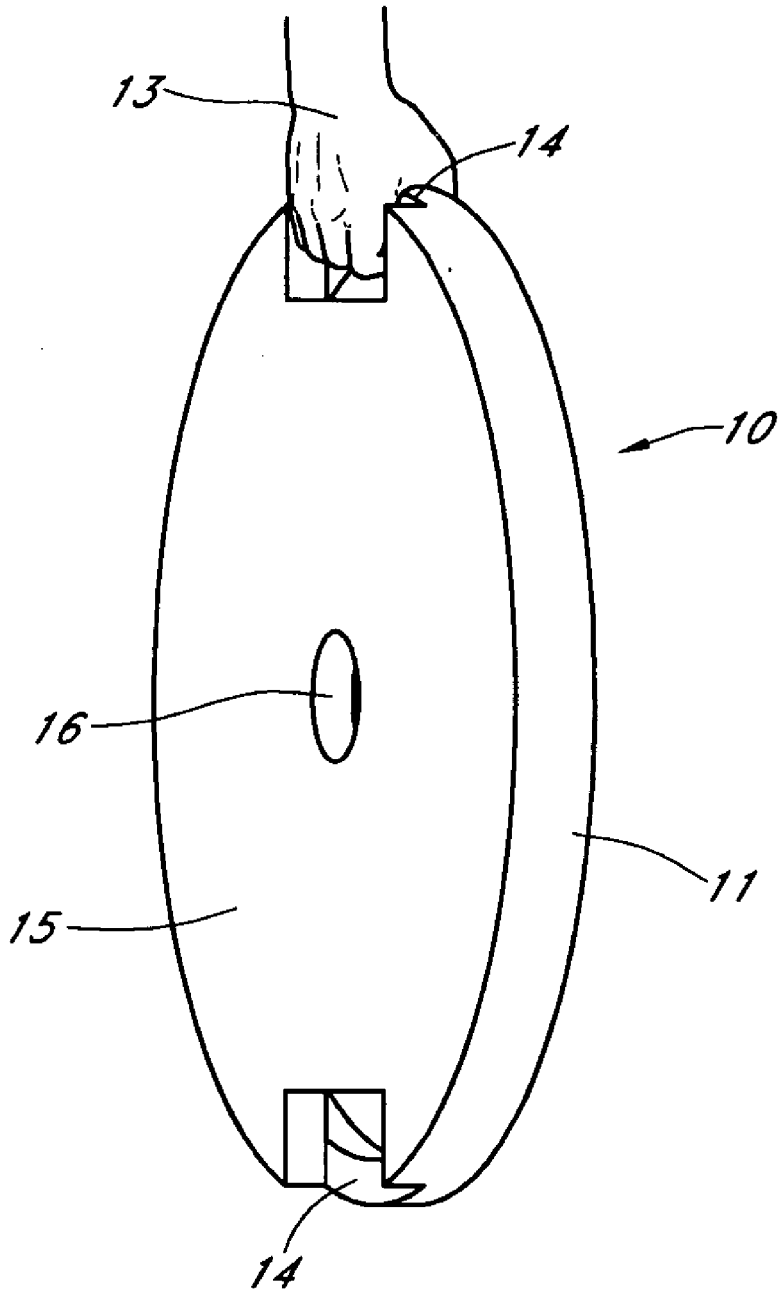
FIGS. 3–6 show the preferred embodiment of the invention.

FIG. 3 shows the invention as disclosed from the side and in the vertical position as initially gripped by the user's hand 13. A portion of the outer rim 11 at the face edge 15 of the weight plate 10 has been removed at the point where the openings 12 are to create a barbell grip 14.

The circular opening 16 may be different diameters to accommodate different barbells and dumbbells. In the preferred embodiment, the diameter of the circular opening 16 is approximately 1¼ inches.

The weight 10 may comprise a suitable metal, such as iron. The weight 10 may be covered with a plastic coating (not shown) for comfort when gripping the weight 10. The weight 10 may also comprise a rigid plastic shell filled with sand.

Figure 4:
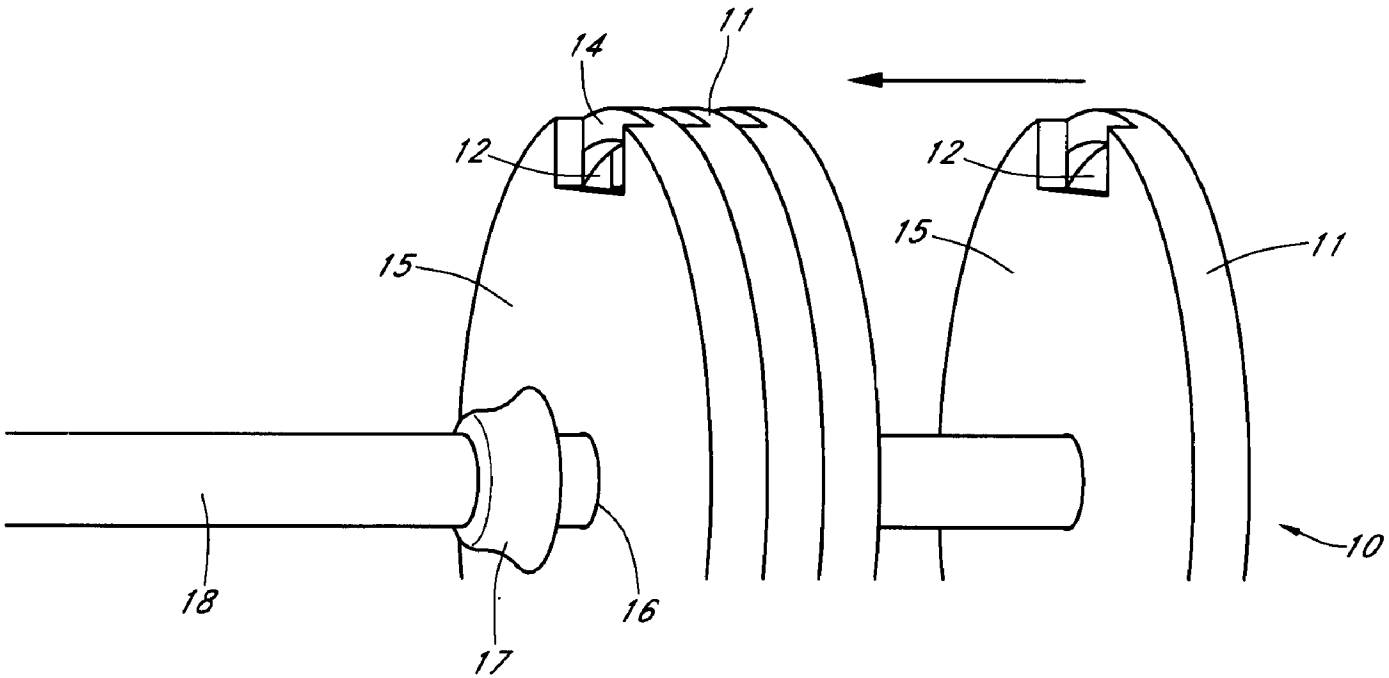

FIG. 4 shows the invention as disclosed from the side and as it used in practice. It should be immediately apparent to those practiced in the arts of the practical advantage of the invention from FIG. 4. As more weight plates 10 are inserted through center hole 16 and onto barbell bar 18, the potential for smashing the user's hand 13 between the edge formed between the face of the plate and the rim of the weight plate is dramatically reduced by barbell grip 14 while still allowing the practical advantage of barbell grip opening 12 for insertion of the user's hand 13. Barbell grip 14 is sized so that an average human hand will be protected when the inner face 15 of the weight plate 10 contacts the outer face of the previously inserted weight plate 10, the inner edges forming barbell grip 14 to protect the user's hand or a hand like device.

Figure 5:
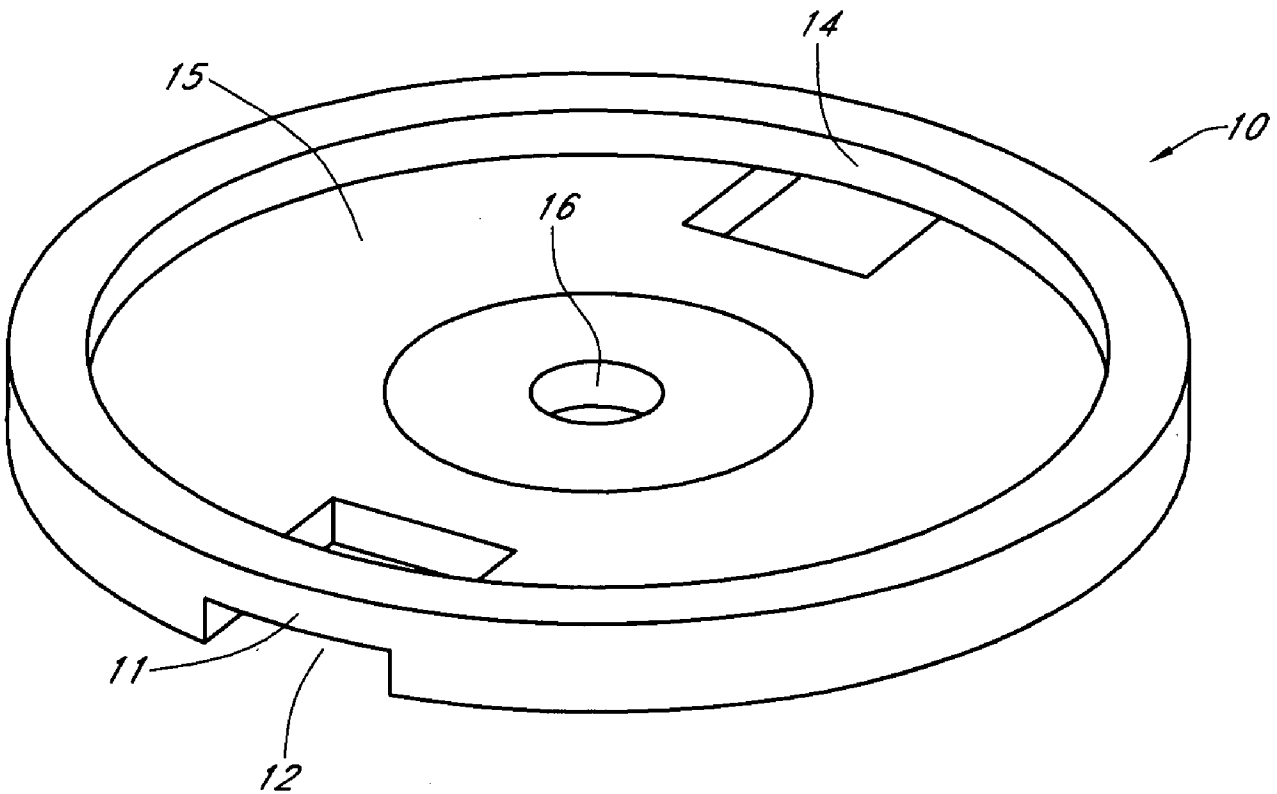

FIG. 5 provides a top view of the outside face 15 of the weight plate 10. This view highlights that rim 11 is continuous along the top side of the face plate. The rim 11 is not continuous along the bottom side of the face plate and removal of a portion of the rim 11 at the barbell weight grip opening allows for a barbell grip 14.

Figure 6:
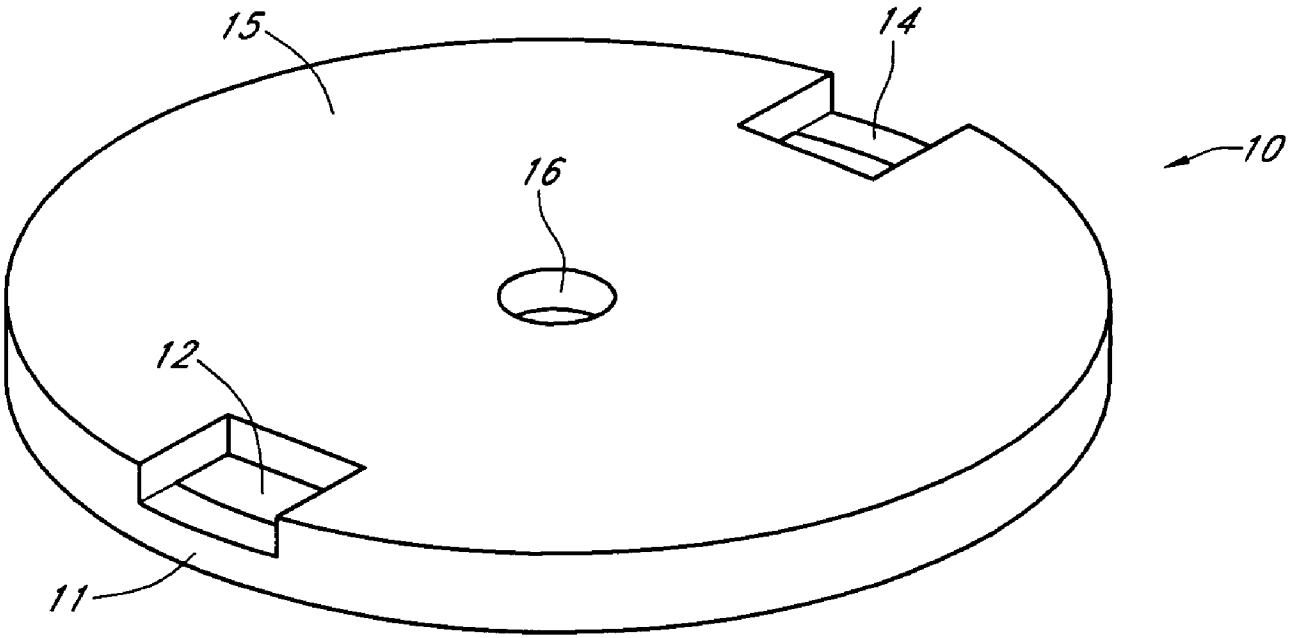

FIG. 6 provides a top view of the inside face 15 of the weight plate 10. This view highlights that rim 11 is not continuous along the outside face 15 of the weight plate 10. The removal of a portion of the rim 11 at the barbell weight grip opening allows for a barbell grip 14.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A weight plate for mounting on a barbell or dumbbell, comprising:

a) a weight plate body having a central bore extending through said weight plate body;

b) a first and second opening located in-line with said central bore and sized to accommodate a human hand;

c) an inner face, said inner face of said weight plate body having a rim edge terminating at said first and second openings;

d) an outer face, said outer face of said weight plate body having a rim edge extending outwardly from said weight plate body and located at the outer perimeter of said weight plate face and wherein said rim edge is continuous about the perimeter of said outer face; and, e) a barbell grip located at the termination of said inner rim edge and adjacent said first and second openings and said outer rim edge.

2. The weight plate of claim 1, wherein the depth of the open gaps is substantially equal to the height of the rim edges.

3. The weight plate of claim 1, characterized by the plate bodies of the weight plates having a space therebetween.

4. The weight plate of claim 2, wherein the weight plates have interlocking means.

5. The weight plate of claim 1, wherein said weight plate is cast, rubber coated or polyurethane coated.

6. The weight plate of claim 1, wherein said one or more openings include edge surfaces which are rounded.

7. The weight plate of claim 1, wherein the thickness of the plate allows the rim edges of both faces to terminate at said openings allowing the plates to be mounted in either direction while still providing protection for the user's hands.

8. The weight plate of claim 1, wherein the weight plate comprises four or more openings.

9. The weight plate of claim 1, wherein there is an opening positioned adjacent each open gap.

10. The weight plate of claim 1, wherein there is an opening positioned at the termination point of each rim edge.

11. The weight plate of claim 3, wherein the weight plates have interlocking means.

12. A weight lifting apparatus allowing engagement of at least one weight plate as described in claim 1.

13. A weight lifting apparatus as described in claim 12 allowing engagement of a plurality of weights.

14. A weight plate for mounting on a barbell or dumbbell, comprising:

a) a weight plate body having a central bore extending through said weight plate body;

b) a first opening radially located in relation to said central bore and sized to accommodate a human hand;

c) a second opening radially located in relation to said central bore and sized to accommodate a human hand;

d) an inner face, said inner face of said weight plate body having a rim edge terminating at said first and second openings;

e) an outer face, said outer face of said weight plate body having a rim edge extending outwardly from said weight plate body and located at the outer perimeter of said weight plate face and wherein said rim edge is continuous about the perimeter of said outer face; and, e) a barbell grip located at the termination of said inner rim edge and adjacent said first and second openings and said outer rim edge.

15. The weight plate of claim 14, wherein the depth of the open gaps is substantially equal to the height of the rim edges.

16. The weight plate of claim 14, characterized by the plate bodies of the weight plates having a space therebetween.

17. The weight plate of claim 16, wherein the weight plates have interlocking means.

18. The weight plate of claim 14, wherein said weight plate is cast, rubber coated or polyurethane coated.

19. The weight plate of claim 14, wherein said one or more openings include edge surfaces which are rounded.

20. The weight plate of claim 14, wherein the thickness of the plate allows the rim edges of both faces to terminate at said openings allowing the plates to be mounted in either direction while still providing protection for the user's hands.

21. The weight plate of claim 14, wherein the weight plate comprises four or more openings.

22. The weight plate of claim 14, wherein there is an opening positioned adjacent each open gap.

23. The weight plate of claim 14, wherein there is an opening positioned at the termination point of each rim edge.

24. A weight lifting apparatus allowing engagement of at least one weight plate as described in claim 14.

25. A weight lifting apparatus as described in claim 14 allowing engagement of a plurality of weights.

* * * * *